US009704431B2

(12) United States Patent
Cho et al.

(10) Patent No.: US 9,704,431 B2
(45) Date of Patent: Jul. 11, 2017

(54) DISPLAY DEVICE

(71) Applicant: LG DISPLAY CO., LTD., Seoul (KR)

(72) Inventors: Daemyeong Cho, Paju-si (KR); Sungjoon Moon, Paju-si (KR); Seungwook Yoo, Seoul (KR); Jaehyuk Kim, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 207 days.

(21) Appl. No.: 14/586,359

(22) Filed: Dec. 30, 2014

(65) Prior Publication Data

US 2016/0078804 A1 Mar. 17, 2016

(30) Foreign Application Priority Data

Sep. 17, 2014 (KR) ..... 10-2014-0123556

(51) Int. Cl.

| | |
|---|---|
| ***G09G 3/3225*** | (2016.01) |
| ***G09G 3/36*** | (2006.01) |
| ***G09G 3/20*** | (2006.01) |
| ***G09G 5/00*** | (2006.01) |

(52) U.S. Cl.

CPC ..... *G09G 3/3225* (2013.01); *G09G 3/20* (2013.01); *G09G 3/3648* (2013.01); *G09G 5/008* (2013.01); *G09G 2310/0289* (2013.01); *G09G 2310/08* (2013.01)

(58) Field of Classification Search

None

See application file for complete search history.

(56) References Cited

U.S. PATENT DOCUMENTS

2008/0218232 A1* 9/2008 Jeon ..... G09G 3/20 327/165
2009/0174646 A1* 7/2009 Lim ..... G09G 3/3677 345/100
2010/0045657 A1* 2/2010 Cheng ..... G09G 3/3674 345/214
2011/0286562 A1* 11/2011 Jeon ..... G09G 3/20 375/371
2012/0139882 A1* 6/2012 Kim ..... G09G 5/008 345/204
2013/0050176 A1* 2/2013 Kim ..... G09G 3/36 345/214
2014/0049532 A1* 2/2014 Choi ..... G09G 5/00 345/213
2015/0067392 A1* 3/2015 Lim ..... G06F 1/12 714/15
2015/0116380 A1* 4/2015 Hussain ..... G09G 3/3406 345/691

* cited by examiner

*Primary Examiner* — Claire X Pappas
*Assistant Examiner* — Benjamin Casarez
(74) *Attorney, Agent, or Firm* — Dentons US LLP

(57) ABSTRACT

Disclosed is a display device and a method of driving the display device. The display device includes a display panel, a scan driving unit, and a timing control unit. The display panel displays an image. The scan driving unit supplies a scan signal to the display panel. The timing control unit controls the scan driving unit. The scan driving unit includes a correction circuit unit that detects whether a clock signal output by the timing control unit is normal or abnormal, and corrects the detected abnormality.

9 Claims, 8 Drawing Sheets

DISPLAY DEVICE

CROSS-REFERENCE TO RELATED APPLICATION

Pursuant to 35 U.S.C. §119(a), this application claims the benefit of earlier filing date and right of priority to Korean Patent Application No. 10-2014-0123556, filed on Sep. 17, 2014, the contents of which are incorporated by reference herein in their entirety.

BACKGROUND OF THE INVENTION

Field of the Invention

This document relates to a display device.

Discussion of the Related Art

As information technology has advanced, the market for display devices, that is, connection media between users and information, is increasing. Accordingly, display devices, such as an Organic Light Emitting Display (OLED), a Liquid Crystal Display (LCD), and a Plasma Display Panel (PDP), are increasingly used.

Some (e.g., an LCD or an OLED) of the aforementioned display devices include a display panel that includes a plurality of subpixels arranged in a matrix form and a driving unit that drives the display panel. The driving unit includes a scan driving unit configured to supply a scan signal (or a gate signal) to the display panel, a data driving unit configured to supply data signals to the display panel, etc.

In such a display device, when scan signals and data signals are supplied to the subpixels arranged in a matrix form, selected subpixels emit light, thus being capable of displaying an image.

The scan driving unit and the data driving unit are controlled by a timing control unit. The timing control unit generates and outputs an on/off-clock signal ON/OFF CLK. A level shift unit configured to operate in conjunction with the scan driving unit generates and outputs a gate clock signal to be supplied to the scan driving unit based on the on/off-clock signal. The scan driving unit operates in response to the gate clock signal of the level shift unit, a start signal, etc. and generates and outputs a scan signal.

The timing control unit may generate abnormality (e.g., abnormal output) in the on/off-clock signal due to a malfunction or the generation of an abnormal signal that is attributable to an external factor. In such a case, the scan driving unit abnormally operates, and the display panel displays an abnormal image. However, a conventional scan driving unit does not have a function for discovering or detecting whether abnormality has occurred in the on/off-clock signal and correcting (or recovering or compensating) such abnormality. Accordingly, there is a need for a solution to such a problem.

SUMMARY OF THE INVENTION

The present invention provides a display device, including a display panel, a scan driving unit configured to supply a scan signal to the display panel, and a timing control unit configured to control the scan driving unit, wherein the scan driving unit includes a correction circuit unit configured to detect whether a clock signal output by the timing control unit is normal or abnormal.

In another aspect, the present invention provides a method of driving a display device, including supplying an on-clock signal and an off-clock signal, output by a timing control unit, to a scan driving unit, detecting whether the on-clock signal and the off-clock signal supplied to the scan driving unit are normal or abnormal, and correcting at least one of the on-clock signal and the off-clock signal when an omission is detected in at least one of the on-clock signal and the off-clock signal.

BRIEF DESCRIPTION OF THE DRAWINGS

The accompany drawings, which are included to provide a further understanding of the invention and are incorporated on and constitute a part of this specification illustrate embodiments of the invention and together with the description serve to explain the principles of the invention.

DETAILED DESCRIPTION OF THE EMBODIMENTS

Reference will now be made in detail to embodiments of the invention some examples of which are illustrated in the accompanying drawings.

First Embodiment

Figure 1:
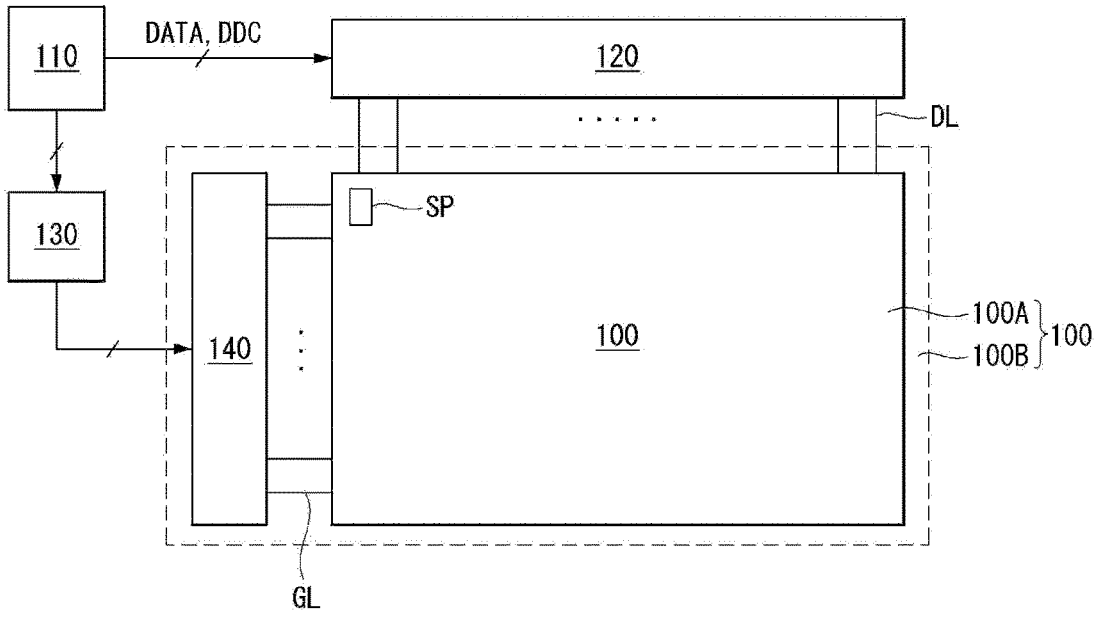
FIG. 1 is a schematic block diagram of a display device.
Figure 2:
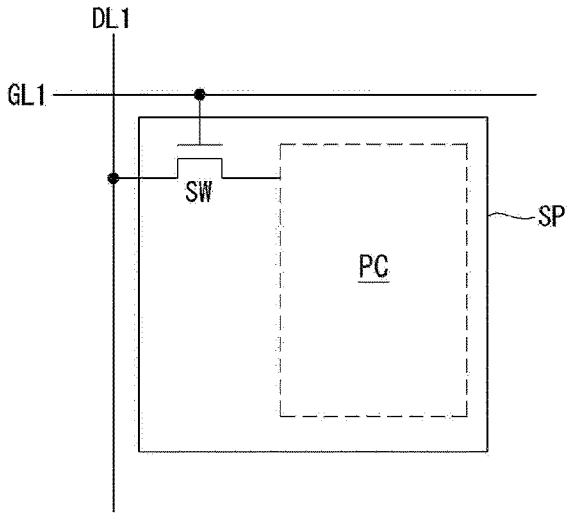
FIG. 2 is an exemplary diagram illustrating the configuration of a subpixel illustrated in FIG. 1.

FIG. 1 is a schematic block diagram of a display device, and FIG. 2 is an exemplary diagram illustrating the configuration of a subpixel illustrated in FIG. 1.

As illustrated in FIG. 1, the display device includes a display panel 100, a timing control unit 110, a data driving unit 120, and scan driving unit 130, 140.

The display panel 100 includes subpixels that are divided into data lines DL and scan lines GL configured to cross each other and that are connected to them. The display panel 100 includes a display area 100A and a non-display area 100B outside the display area 100A. The subpixels are formed in the display area 100A, and various signal lines, a pad, etc. are formed in the non-display area 100B. The display panel 100 may be implemented using an LCD, an OLED, an electrophoretic display (EPD) or the like.

As illustrated in FIG. 2, a single subpixel SP includes a switching transistor SW connected to a scan line GL 1 and a data line DL1 and a pixel circuit PC configured to operate in response to a data signal DATA that is supplied in response to a scan signal supplied through the switching transistor SW. The subpixels SP are implemented into an LCD panel including a liquid crystal element or an OLED panel including an organic light-emitting element depending on a configuration of the pixel circuit PC.

If the display panel 100 is configured using an LCD panel, the display panel is implemented in Twisted Nematic (TN) mode, Vertical Alignment (VA) mode, In Plane Switching (IPS) mode, Fringe Field Switching (FFS) mode, or Electrically Controlled Birefringence (ECB) mode. If the display panel 100 is configured using an OLED panel, the display panel is implemented using a top-emission method, a bottom-emission method, or a dual-emission method.

The timing control unit 110 receives timing signals, such as a vertical sync signal, a horizontal sync signal, a data enable signal, and a clock signal, through the reception circuit of an LVDS or TMDS interface connected to a video board. The timing control unit 110 generates timing control signals for controlling the operation timing of the data driving unit 120 and the scan driving unit 130, 140 in response to a received timing signal.

The data driving unit 120 includes a plurality of source drive Integrated Circuits (ICs). The source drive ICs are supplied with a data signal DATA and a source timing control signal DDC from the timing control unit 110. The source drive ICs convert the data signal DATA of a digital signal into an analog signal in response to the source timing control signal DDC and supply the analog signal through the data lines DL of the display panel 100. The source drive ICs are connected to the data lines DL of the display panel 100 through a Chip On Glass (COG) process or a Tape Automated Bonding (TAB) process.

The scan driving unit 130, 140 includes a level shift unit 130 and a shift register unit 140. The scan driving unit 130, 140 is formed using a Gate In Panel (GIP) method in which the level shift unit 130 and the shift register unit 140 are separated.

The level shift unit 130 is formed in an external board connected to the display panel 100 in an IC form. The level shift unit 130 generates a power source along with a gate clock signal based on the on/off-clock signal generated by the timing control unit 110, shifts the level of the generated gate clock signal and power source, and supplies the resulting gate clock signal and power source to the shift register unit 140. The level shift unit 130 may include a power supply unit configured to generate and output a power source.

The shift register unit 140 is formed in a thin film transistor form in the non-display area 100B of the display panel 100 using a GIP method. The shift register unit 140 includes stages configured to shift and output scan signals in response to a gate clock signal and a power source generated by the level shift unit 130. The stages of the shift register unit 140 sequentially output the scan signals through output stages.

In an embedded scan driving unit in which the level shift unit 130 and the shift register unit 140 are separate and formed as described above, the shift register unit 140 is implemented using an oxide or amorphous silicon thin film transistor. The oxide thin film transistor is advantageous in that the size of a circuit can be reduced compared to the amorphous silicon thin film transistor because it has an excellent current mobility characteristic. The amorphous silicon thin film transistor is advantageous in that it has an excellent threshold voltage recovery characteristic according to a stress bias compared to the oxide thin film transistor because a threshold voltage remains constant according to a lapse of time.

The timing control unit 110 may generate abnormality (e.g., abnormal output) in the on/off-clock signal due to a malfunction or the generation of an abnormal signal attributable to an external factor. In such a case, the level shift unit 130 and the shift register unit 140 that form the scan driving unit 130, 140 abnormally operate, and the display panel 100 displays an abnormal image.

In order to solve such a problem, the present invention provides a device capable of discovering or detecting whether the on/off-clock signal output by the timing control unit 110 is normal or abnormal and of correcting (or recovering or compensating) such abnormality in the level shift unit 130. Such a device is described below.

Figure 3:
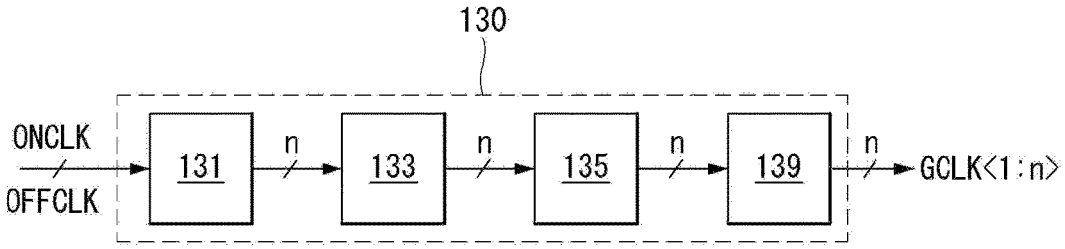
FIG. 3 a schematic block diagram of a level shift unit in accordance with a first embodiment of the present invention.
Figure 4:
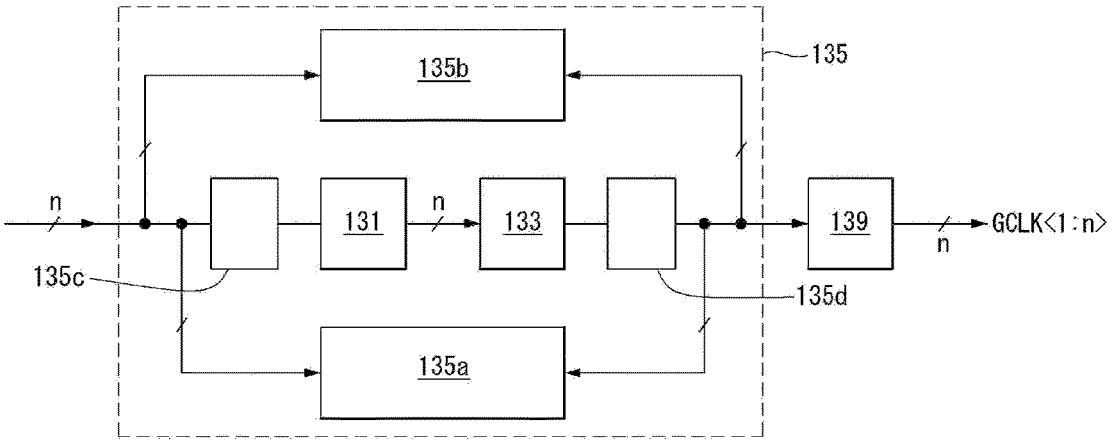
FIG. 4 is a schematic block diagram illustrating a correction circuit unit of FIG. 3.
Figure 5:
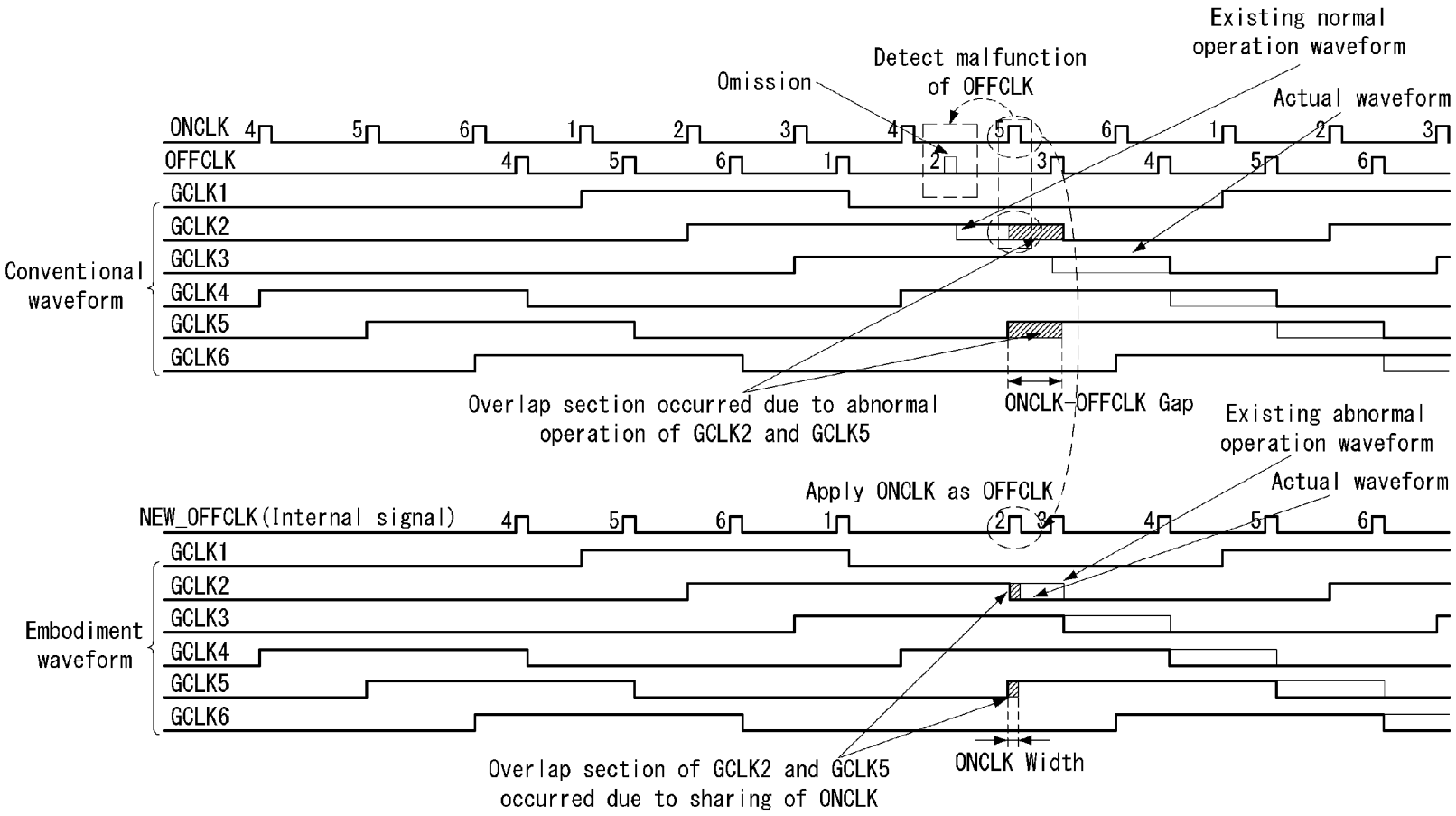
FIG. 5 is a waveform diagram illustrating the recovery of the omission error of an off-clock signal.
Figure 6:
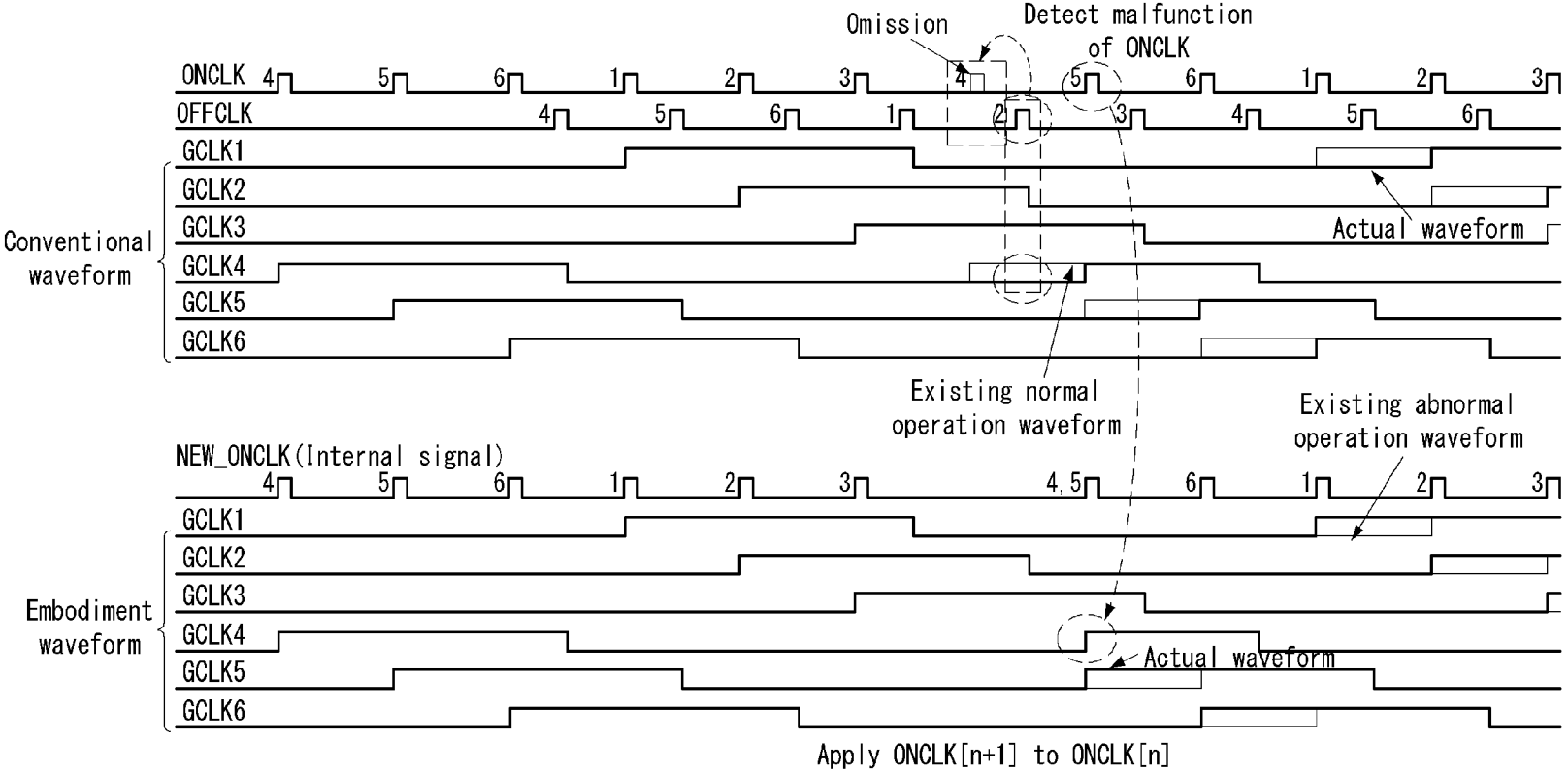
FIG. 6 is a waveform diagram illustrating the recovery of the omission error of an on-clock signal.

FIG. 3 a schematic block diagram of the level shift unit in accordance with a first embodiment of the present invention, FIG. 4 is a schematic block diagram illustrating a correction circuit unit of FIG. 3, FIG. 5 is a waveform diagram illustrating the recovery of the omission error of an off-clock signal, and FIG. 6 is a waveform diagram illustrating the recovery of the omission error of an on-clock signal.

As illustrated in FIG. 3, the level shift unit 130 in accordance with the first embodiment of the present invention includes a signal branch unit 131, a signal selection unit 133, a correction circuit unit 135, and a level conversion unit 139.

The signal branch unit 131 functions to branch each of an on-clock signal ONCLK and an off-clock signal OFFCLK from the timing control unit into n (n is an integer of 2 or more) gate clock signals.

The signal selection unit 133 functions to selectively assign logic low and logic high to gate clock signals that belong to the gate clock signals output by the signal branch unit 131 and that correspond to the on-clock signal ONCLK and to output the resulting gate clock signals.

The correction circuit unit 135 functions to discover or detect whether the on-clock signal ONCLK and the off-clock signal OFFCLK are abnormal based on the on-clock signal ONCLK and the off-clock signal OFFCLK supplied to the front end of the signal branch unit 131 and the gate clock signals output from the rear end of the signal selection unit 133 and to correct (or recover or compensate) such abnormality if the abnormality has occurred.

An example in which the correction circuit unit 135 detects whether an omission has occurred in the on-clock signal ONCLK or the off-clock signal OFFCLK and corrects the on-clock signal ONCLK and the off-clock signal OFFCLK if the omission has occurred in the on-clock signal ONCLK or the off-clock signal OFFCLK is described below, for convenience of description.

The level conversion unit 139 functions to convert the levels of gate clock signals output by the signal selection unit 133 into levels at which the transistor of the display panel may be driven and to output finally generated gate clock signals GCLK.

As illustrated in FIG. 4, the correction circuit unit 135 includes a first correction circuit unit 135*a*, a second correction circuit unit 135*b*, a third correction circuit unit 135*c*, and a fourth correction circuit unit 135*d*.

The first correction circuit unit 135*a* functions to detect whether an omission has occurred in the off-clock signal OFFCLK based on the on-clock signal ONCLK supplied to the front end of the signal branch unit 131 and the on-clock signal ONCLK and the off-clock signal OFFCLK output from the rear end of the fourth correction circuit unit 135*d*.

The second correction circuit unit 135*b* functions to detect whether an omission has occurred in the on-clock signal ONCLK based on the off-clock signal OFFCLK supplied to the front end of the signal branch unit 131 and the on-clock signal ONCLK and the off-clock signal OFFCLK output from the rear end of the fourth correction circuit unit 135*d*.

When an omitted part is generated in the on-clock signal ONCLK or the off-clock signal OFFCLK, the third correction circuit unit 135*c* functions to correct the omitted part of the on-clock signal ONCLK or the off-clock signal OFFCLK by replacing the omitted part. More specifically, in order to correct the omitted part of the off-clock signal OFFCLK, the third correction circuit unit 135*c* replaces an on-clock signal ONCLK with an off-clock signal OFFCLK. That is, if the omitted part is generated in the off-clock signal OFFCLK, the third correction circuit unit 135*c* corrects a clock signal in such a way as to fill the omitted part with the on-clock signal ONCLK.

When an omitted part is generated in the on-clock signal ONCLK or the off-clock signal OFFCLK, the fourth correction circuit unit 135*d* functions to correct gate clock signals. More specifically, the fourth correction circuit unit 135*d* performs logic processing in order to correct the omitted part of the on-clock signal ONCLK. That is, when the omitted part is generated in the on-clock signal ONCLK, the fourth correction circuit unit 135*d* corrects gate clock signals in such a way as to make one of the gate clock signals (e.g., an Nth gate clock signal having an abnormal waveform attributable to the omission of the on-clock signal ONCLK) and a next gate clock signal (e.g., an (N+1)th gate clock signal next to the Nth gate clock signal) in the same logic state.

The correction circuit unit 135 is described in more detail below with reference to FIGS. 4 to 6.

Correction (or Recovery) of Omission Error of Off-Clock Signal

—A Conventional Problem: Refer to a Conventional Waveform of FIG. 5—

If an omission is not generated in an off-clock signal OFFCLK, gate clock signals GCLK1~GCLK6 switch to a logic high state in response to an on-clock signal ONCLK and switch to a logic low state in response to the off-clock signal OFFCLK.

For example, a first gate clock signal GCLK1 switches to a logic high state in response to the rising edge of a first on-clock signal ONCLK_1 and switches to a logic low state in response to the falling edge of a first off-clock signal OFFCLK_1.

Furthermore, as in an existing normal operation waveform, the second gate clock signal GCLK2 switches to a logic high state in response to the rising edge of a second on-clock signal ONCLK_2 and switches to a logic low state in response to the falling edge of a second off-clock signal OFFCLK_2.

If an omission is generated in one of off-clock signals OFFCLK, however, the gate clock signals GCLK1~GCLK6 switch to a logic high state in response to the on-clock signal ONCLK and some of the gate clock signals GCLK1~GCLK6 do not switch to a logic low state in response to the off-clock signal OFFCLK.

For example, the second gate clock signal GCLK2 switches to a logic high state in response to the rising edge of the second on-clock signal ONCLK_2. As in an actual waveform, however, the second gate clock signal GCLK2 does not switch to a logic low state in response to the falling edge of the second off-clock signal OFFCLK_2 and switches to a logic low state in response to the falling edge of a third off-clock signal OFFCLK_3.

Furthermore, the third gate clock signal GCLK3 switches to a logic high state in response to the rising edge of a third on-clock signal ONCLK_3. As in the actual waveform, however, the third gate clock signal GCLK3 does not switch to a logic low state in response to the falling edge of the third off-clock signal OFFCLK_3 and switches to a logic low state in response to the falling edge of a fourth off-clock signal OFFCLK_4.

If such a phenomenon is generated, an overlap section, such as an "ONCLK-OFFCLK gap", is generated between gate clock signals due to the abnormal operations of the second gate clock signal GCLK2 and the fifth gate clock signal GCLK5. If such a phenomenon is generated as described above, display quality and reliability of a product are deteriorated because the display panel displays an abnormal image.

—Improvements According to an Embodiment: Refer to a Waveform According to an Embodiment of FIG. 5—

If an omission is generated in an off-clock signal OFFCLK, gate clock signals GCLK1·GCLK6 switch to a logic high state in response to an on-clock signal ONCLK and switch to a logic low state in response to the off-clock signal OFFCLK.

For example, the first gate clock signal GCLK1 switches to a logic high state in response to the rising edge of a first on-clock signal ONCLK_1 and switches to a logic low state in response to the falling edge of a first off-clock signal OFFCLK_1.

Furthermore, as in the existing normal operation waveform, the second gate clock signal GCLK2 switches to a logic high state in response to the rising edge of a second on-clock signal ONCLK_2 and switches to a logic low state in response to the falling edge of a second off-clock signal OFFCLK_2.

In contrast, if an omission is generated in one of off-clock signals OFFCLK, the gate clock signals GCLK1~GCLK6 switch to a logic high state in response to the on-clock signal ONCLK, and some of the gate clock signals GCLK1~GCLK6 switch to a logic low state in response to an off-clock signal NEW_OFFCLK that has been newly generated by the operation of the correction circuit unit.

For example, the second gate clock signal GCLK2 switches to a logic high state in response to the rising edge of the second on-clock signal ONCLK_2 and, as in the actual waveform, switches to a logic low state in response to the rising edge of the second off-clock signal OFFCLK_2 that has been newly generated.

When the actual waveform is compared with the existing abnormal operation waveform, in the actual waveform, the second gate clock signal GCLK2 may switch to a logic low state in response to the rising edge of the second off-clock signal OFFCLK_2 that has been newly generated. As a result, according to the present invention, a section (or time) in which the malfunction of a signal occurs can be narrowed compared to a conventional technology.

In accordance with an embodiment of the present invention, if an omission is generated in an off-clock signal OFFCLK, the correction circuit unit fills the omitted part with an on-clock signal ONCLK (i.e., an on-clock signal subsequent to the omitted off-clock signal). In the present invention, this is called "ONCLK sharing".

Since the correction circuit unit performs such a correction operation, an overlap section generated between gate clock signals, such as an "ONCLK width", can be significantly reduced compared to a prior art although an abnormal operation is generated in the second gate clock signal GCLK2 and the fifth gate clock signal GCLK5. That is, according to the present invention, although an omission is generated in an off-clock signal OFFCLK, overlap corresponding to only a single on-clock signal is generated between gate clock signals.

Accordingly, the present invention can immediately correct (or recover) such a phenomenon although the phenomenon is generated. As a result, problems in which display quality and reliability of a product are deteriorated can be prevented because the display panel can display a normal image.

Correction (or Recovery) of Omission Error of On-Clock Signal

—A Conventional Problem: Refer to a Conventional Waveform of FIG. 6—

If an omission is not generated in an on-clock signal ONCLK, gate clock signals GCLK1~GCLK6 switch to a logic high state in response to the on-clock signal ONCLK and switch to a logic low state in response to an off-clock signal OFFCLK.

For example, the third gate clock signal GCLK3 switches to a logic high state in response to the rising edge of a third on-clock signal ONCLK_3 and switches to a logic low state in response to the falling edge of a third off-clock signal OFFCLK_3.

Furthermore, as in the existing normal operation waveform, the fourth gate clock signal GCLK4 switches to a logic high state in response to the rising edge of a fourth on-clock signal ONCLK_4 and switches to a logic low state in response to the falling edge of a fourth off-clock signal OFFCLK_4.

If an omission is generated in one of on-clock signals ONCLK, some of the gate clock signals GCLK1~GCLK6 do not switch to a logic high state in response to the on-clock signal ONCLK, but switch to a logic low state in response to the off-clock signal OFFCLK.

For example, as in the existing normal operation waveform, the fourth gate clock signal GCLK4 needs to switch to a logic high state in response to the rising edge of a fourth on-clock signal ONCLK_4 and needs to switch to a logic low state in response to the falling edge of a fourth off-clock signal OFFCLK_4.

If an omission is generated in the fourth on-clock signal ONCLK_4, however, as in an actual waveform, the fourth gate clock signal GCLK4 switches to a logic high state in response to the rising edge of a fifth on-clock signal ONCLK_5 and switches to a logic low state in response to the falling edge of the fourth off-clock signal OFFCLK_4. That is, if an omission is generated in the fourth on-clock signal ONCLK_4, the logic high section of the fourth gate clock signal GCLK4 is shortened as in the actual waveform.

Furthermore, as in the existing normal operation waveform, the fifth gate clock signal GCLK5 needs to switch to a logic high state in response to the rising edge of the fifth on-clock signal ONCLK_5 and needs to switch to a logic low state in response to the falling edge of a fifth off-clock signal OFFCLK_5.

If an omission is generated in the fifth on-clock signal ONCLK_5, however, as in the actual waveform, the fifth gate clock signal GCLK5 switches to a logic high state in response to the rising edge of a sixth on-clock signal ONCLK_6 and switches to a logic low state in response to the falling edge of the fifth off-clock signal OFFCLK_5. That is, if an omission is generated in the fifth on-clock signal ONCLK_5, the logic high section of the fifth gate clock signal GCLK5 is shortened as in the actual waveform.

As a result, the logic high sections of gate clock signals generated after an on-clock signal is omitted are shortened. If such a phenomenon is generated, display quality and reliability of a product are deteriorated because the display panel displays an abnormal image.

—Improvements According to an Embodiment: Refer to a Waveform According to an Embodiment of FIG. 6—

If an omission is not generated in an on-clock signal ONCLK, gate clock signals GCLK1~GCLK6 switch to a logic high state in response to the on-clock signal ONCLK and switch to a logic low state in response to an off-clock signal OFFCLK.

For example, the first gate clock signal GCLK1 switches to a logic high state in response to the rising edge of a first on-clock signal ONCLK_1 and switches to a logic low state in response to the falling edge of a first off-clock signal OFFCLK_1.

Furthermore, the second gate clock signal GCLK2 switches to a logic high state in response to the rising edge of a second on-clock signal ONCLK_2 and switches to a logic low state in response to the falling edge of a second off-clock signal OFFCLK_2.

In contrast, if an omission is generated in one of on-clock signals ONCLK, the gate clock signals GCLK1~GCLK6 switch to a logic high state in response to an on-clock signal NEW_ONCLK that has been newly generated by the operation of the correction circuit unit. More specifically, if an omission is generated in a waveform due to the omission of an on-clock signal, the correction circuit unit considers a clock signal having the omitted waveform to be the same as a next on-clock signal. In other words, the correction circuit unit corrects the on-clock signal NEW_ONCLK so that fourth and fifth on-clock signals ONCLK_4 and ONCLK_5 are considered to be present in the same section. Accordingly, two gate clock signals placed in the section from which the on-clock signal has been omitted are treated as the same logic state.

For example, if an omission is generated in the fourth on-clock signal ONCLK_4, the fourth gate clock signal GCLK4 switches to a logic high state in response to the rising edge of the fifth on-clock signal ONCLK_5 and switches to a logic low state in response to the falling edge of a fourth off-clock signal OFFCLK_4.

The fifth gate clock signal GCLK5 switches to a logic high state in response to the rising edge of the fifth on-clock signal ONCLK_5 and switches to a logic low state in response to the falling edge of a fifth off-clock signal OFFCLK_5.

When the actual waveform is compared with the existing abnormal operation waveform, the fifth gate clock signal GCLK5 switches to a logic high state in response to the rising edge of the fifth on-clock signal ONCLK5 not a sixth on-clock signal ONCLK_6 as can be seen from the actual waveform. The reason for this is that the fourth and the fifth on-clock signals ONCLK_4 and ONCLK_5 are considered to be present in the same section due to the on-clock signal NEW_ONCLK that has been newly generated.

Accordingly, if abnormality is generated in a waveform due to the omission of an on-clock signal, an Nth gate clock signal corresponding to the omitted part and an (N+1)th gate clock signal, that is, a gate clock signal subsequent to the Nth gate clock signal, are processed to be logic high, that is, the same logic state, at the same point of time. Accordingly, the present invention can prevent a problem in that a section (or time) in which the malfunction of a signal occurs is consecutively generated compared to a prior art.

In accordance with an embodiment of the present invention, when an omission is generated in an on-clock signal, the correction circuit unit considers the omitted on-clock signal to be the same as a next on-clock signal and performs correction so that an Nth gate clock signal corresponding to the omitted part of an on-clock signal ONCLK and an (N+1)th gate clock signal, that is, a gate clock signal subsequent to the Nth gate clock signal, are processed to be logic high, that is, the same logic state, at the same point of time.

Since the correction circuit unit performs such a correction operation, problems in that the logic high section of a gate clock signal is delayed and the logic high section (or pulse width) of the gate clock signal is narrowed after an omission is generated in an on-clock signal as in an existing abnormal operation waveform can be prevented.

Accordingly, although such a phenomenon is generated, the present invention can correct (or recover) the phenomenon. As a result, a problem in that display quality and reliability of a product are deteriorated can be prevented because the display panel can display a normal image.

The configuration of the level shift unit in accordance with the first embodiment of the present invention is described in more detail below.

Figure 7:
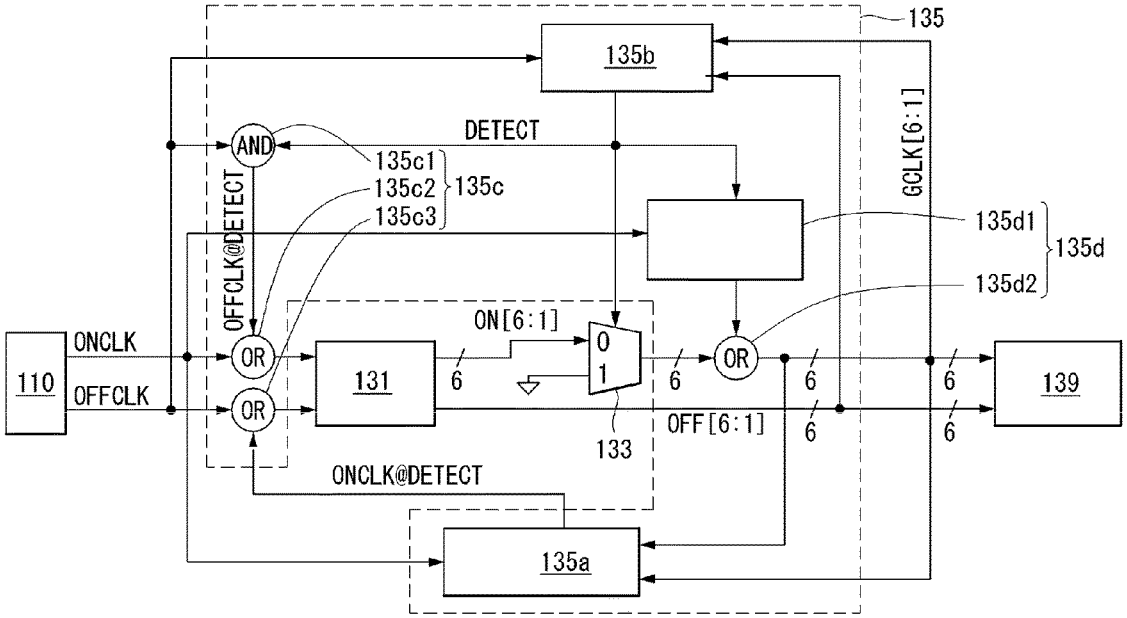
FIG. 7 is a detailed block diagram of a level shift unit in accordance with the first embodiment of the present invention.
Figure 8:
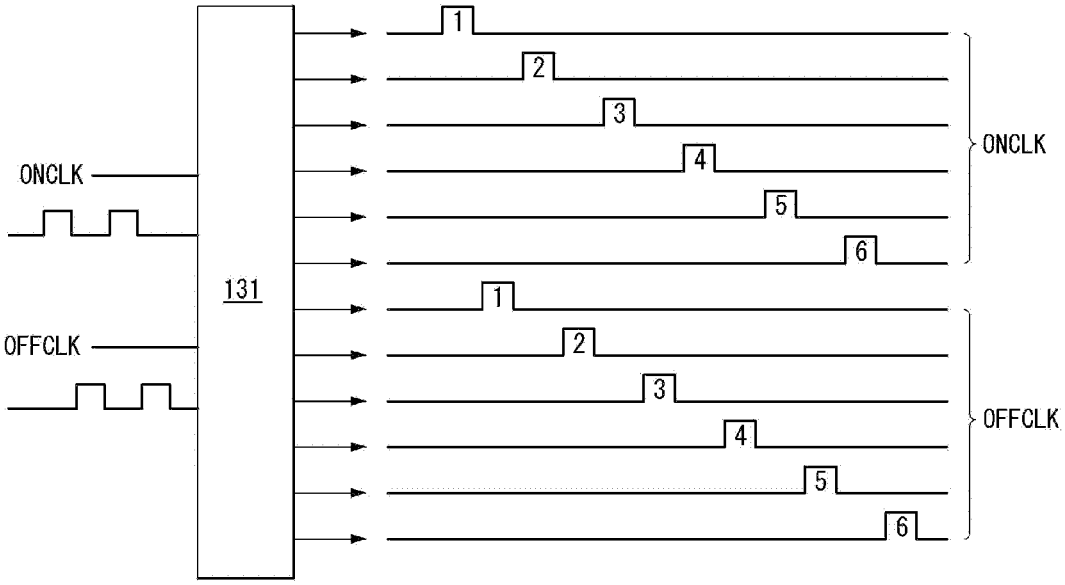
FIG. 8 is an exemplary diagram illustrating a signal branch unit.
Figure 9:
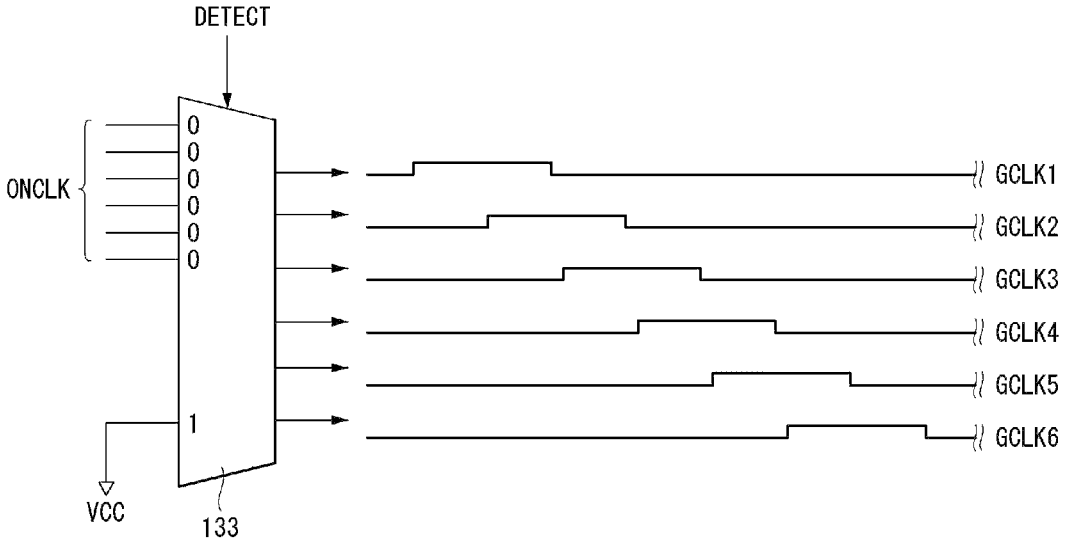
FIG. 9 is an exemplary diagram illustrating a signal selection unit.

FIG. 7 is a detailed block diagram of the level shift unit 130 in accordance with the first embodiment of the present invention, FIG. 8 is an exemplary diagram illustrating the signal branch unit 131, and FIG. 9 is an exemplary diagram illustrating the signal selection unit 133.

As illustrated in FIGS. 7 to 9, the level shift unit 130 in accordance with the first embodiment of the present invention includes the signal branch unit 131, the signal selection unit 133, the correction circuit unit 135, and the level conversion unit 139. The level shift unit 130 may output a 6-phase gate clock signal.

The signal branch unit 131 branches each of an on-clock signal ONCLK and an off-clock signal OFFCLK, output by the timing control unit 110, into 6 gate clock signals and outputs the 12 gate clock signals. (refer to FIG. 8)

The signal selection unit 133 selectively assigns logic low and logic high to gate clock signals GCLK1~GCLK6 that belong to the 12 gate clock signals output by the signal branch unit 131 and that correspond to the on-clock signal ONCLK and outputs the resulting gate clock signals GCLK1~GCLK6. (refer to FIG. 9)

The correction circuit unit 135 detects whether an omission has occurred in the on-clock signal ONCLK or the off-clock signal OFFCLK based on the on-clock signal ONCLK and the off-clock signal OFFCLK supplied to the front end of the signal branch unit 131 and the gate clock signals output from the rear end of the signal selection unit 133 and corrects (or recovers or compensates) such an omission if the omission is generated in the on-clock signal ONCLK or the off-clock signal OFFCLK.

The level conversion unit 139 converts the levels of gate clock signals output by the signal selection unit 133 into levels at which the transistor of the display panel may be driven and outputs finally generated gate clock signals GCLK.

The correction circuit unit 135 includes the first correction circuit unit 135*a*, the second correction circuit unit 135*b*, the third correction circuit unit 135*c*, and the fourth correction circuit unit 135*d*.

The first correction circuit unit 135*a* detects whether an omission has occurred in the off-clock signal OFFCLK based on the on-clock signal ONCLK supplied to the front end of the signal branch unit 131 and the on-clock signal ONCLK and the off-clock signal OFFCLK output by the fourth correction circuit unit 135*d*. If an omission is detected in the off-clock signal OFFCLK, the first correction circuit unit 135*a* generates and outputs an on detection signal ONCLK@DETECT so that the omitted part may be replaced with the on-clock signal ONCLK.

If a single off-clock signal OFFCLK is generated between two on-clock signals ONCLK, the first correction circuit unit 135*a* recognizes the single off-clock signal OFFCLK as a normal state. In contrast, if a single off-clock signal OFFCLK is not generated between two on-clock signals ONCLK, the first correction circuit unit 135*a* recognizes the single off-clock signal OFFCLK as an abnormal state (i.e., an off-clock signal omission state).

If the single off-clock signal OFFCLK is recognized as the abnormal state (i.e., the off-clock signal omission state), the first correction circuit unit 135*a* generates and outputs a first correction signal ONCLK@DETECT so that a subsequent on-clock signal in place of the omitted off-clock signal can be recognized and driven as the omitted off-clock signal.

The second correction circuit unit 135*b* functions to detect whether an omission has occurred in the on-clock signal ONCLK based on the off-clock signal OFFCLK supplied to the front end of the signal branch unit 131 and the on-clock signal ONCLK and the off-clock signal OFFCLK output by the fourth correction circuit unit 135*d*. If an omission is detected in the on-clock signal ONCLK, the second correction circuit unit 135*b* generates and outputs a detection signal DETECT so that the omitted gate clock signal can be corrected.

The second correction circuit unit 135*b* recognizes a single on-clock signal as a normal state if the single on-clock signal is generated between two off-clock signals and recognizes a single on-clock signal as an abnormal state (i.e., an on-clock signal omission state) if the single on-clock signal is not generated between two off-clock signals.

Furthermore, the second correction circuit unit 135*b* recognizes a gate clock signal after next (e.g., an (N+2)th gate clock signal) as a normal state only when the gate clock signal after next maintains a logic high state until one gate clock signal (e.g., an Nth gate clock signal) is terminated. In contrast, the second correction circuit unit 135*b* recognizes a gate clock signal after next (e.g., an (N+2)th gate clock signal) as an abnormal state (i.e., an on-clock signal omission state) if the gate clock signal after next does not maintains a logic high state until one gate clock signal (e.g., an Nth gate clock signal) is terminated. That is, the second correction circuit unit 135*b* may determine whether the state of a signal is normal or abnormal using one of the state of an on/off-clock signal and the state of a gate clock signal.

If the state of a signal is recognized as an abnormal state (i.e., an on-clock signal omission state), the second correction circuit unit 135*b* considers an on-clock signal (e.g., an (N+1)th on-clock signal) subsequent to an omitted on-clock signal (e.g., an Nth on-clock signal) to be the same as the omitted on-clock signal.

The third correction circuit unit 135*c* functions to correct an omitted part of the on-clock signal ONCLK the off-clock signal OFFCLK based on the on detection signal ONCLK@DETECT supplied by the first correction circuit unit 135*a* and the detection signal DETECT supplied by the second correction circuit unit 135*b*. The third correction circuit unit 135*c* corrects an omitted part by adding an on-clock signal or an off-clock signal.

The third correction circuit unit 135*c* includes (3-1)th to (3-3)th correction circuit units 135*c*1 ~135*c*3.

The (3-1)th correction circuit unit 135*c*1 functions to generate and output an off detection signal OFFCLK@DETECT by multiplying the detection signal DETECT output by the second correction circuit unit 135*b* and the off-clock signal OFFCLK output by the timing control unit 110 together (or by performing AND operation on the detection signal DETECT and the off-clock signal OFFCLK).

The (3-2)th correction circuit unit 135*c*2 functions to correct the on-clock signal ONCLK by adding the off detection signal OFFCLK@DETECT supplied by the (3-1) th correction circuit unit 135*c*1 and the on-clock signal ONCLK output by the timing control unit 110 (or by performing OR operation on the off detection signal OFFCLK@DETECT and the on-clock signal ONCLK).

The (3-1)th correction circuit unit 135*c*3 functions to correct the off-clock signal OFFCLK by adding the on detection signal ONCLK@DETECT supplied by the first correction circuit unit 135*a* and the off-clock signal OFF-CLK output by the timing control unit 110 (or by performing OR operation on the on detection signal ONCLK@DETECT and the off-clock signal OFFCLK).

The fourth correction circuit unit 135*d* functions to correct gate clock signals output by the signal selection unit 133 based on the on-clock signal ONCLK supplied to the front end of the signal branch unit 131 and a second correction signal output by the second correction circuit unit 135*b*.

The fourth correction circuit unit 135*d* includes a (4-1)th correction circuit unit 135*d*1 and a (4-2)th correction circuit unit 135*d*2.

The (4-1)th correction circuit unit 135*d*1 functions to determine whether to output a signal, which changes the logic state of a next gate clock signal into logic high based on the detection signal DETECT supplied by the second correction circuit unit 135*d* and the on-clock signal ONCLK output by the timing control unit 110.

The (4-2)th correction circuit unit 135*d*2 functions to add a gate clock signal output by the signal selection unit 133 and a logic signal output by the (4-1)th correction circuit unit 135*d*1 so that the on-clock signal ONCLK is processed to be the same logic high state as an omitted gate clock signal and a next gate clock signal.

The fourth correction circuit unit 135*d* may correct gate clock signals in such a way as to process one (e.g., an Nth gate clock signal having an abnormal waveform attributable to the omission of an on-clock signal) of gate clock signals output by the signal selection unit 133 and a gate clock signal subsequent to the Nth gate clock signal (e.g., an (N+1)th gate clock signal placed next to the Nth gate clock signal) to become the same logic state.

In accordance with the aforementioned configuration, when an abnormal signal occurs, the level shift unit in accordance with the first embodiment of the present invention can detect whether abnormality has occurred in an on/off-clock signal output by the timing control unit and correct the abnormality through recovery, such as the delay or skip of a waveform and the addition and replacement of a signal.

Second Embodiment

Figure 10:
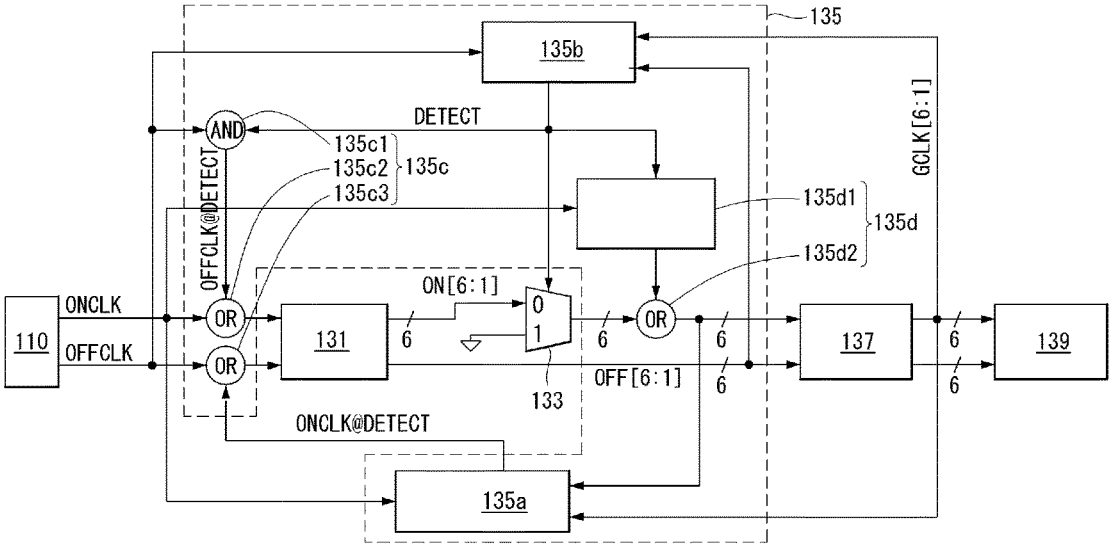
FIG. 10 is a detailed block diagram of a level shift unit in accordance with a second embodiment of the present invention.
Figure 11:
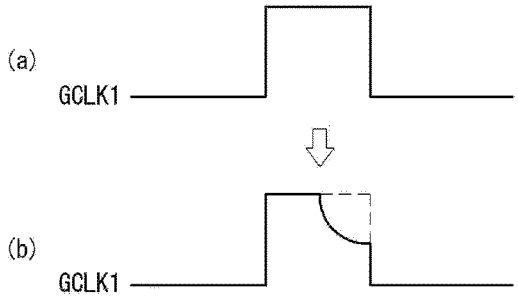
FIG. 11 is an exemplary diagram illustrating control of signals by a signal control unit.

FIG. 10 is a detailed block diagram of a level shift unit in accordance with a second embodiment of the present invention, and FIG. 11 is an exemplary diagram illustrating control of signals by a signal control unit.

As in the first embodiment, in the second embodiment of the present invention, when an abnormal signal occurs, the level shift unit can detect whether an abnormality has occurred in an on/off-clock signal output by the timing control unit and correct the abnormality through recovery, such as the delay or skip of a waveform and the addition and replacement of a signal.

The level shift unit in accordance with the second embodiment of the present invention is the same as that of the first embodiment of the present invention except that only a signal control unit is added. Accordingly, only the signal control unit is described in brief, and a detailed description of the remaining elements is omitted.

As illustrated in FIGS. 10 and 11, the level shift unit in accordance with the second embodiment of the present invention includes the signal branch unit 131, the signal selection unit 133, the correction circuit unit 135, the signal control unit 137, and the level conversion unit 139. The level shift unit has been illustrated as outputting a 6-phase gate clock signal, but is not limited thereto.

The signal branch unit 131 branches each of an on-clock signal ONCLK and an off-clock signal OFFCLK output by the timing control unit 110 into 6 gate clock signals and outputs the 12 gate clock signals.

The signal selection unit 133 selectively assigns logic low and logic high to gate clock signals GCLK1~GCLK6 that belong to the 12 gate clock signals output by the signal branch unit 131 and that correspond to the on-clock signal ONCLK and outputs the resulting gate clock signals GCLK1~GCLK6.

The correction circuit unit 135 detects whether an omission has occurred in the on-clock signal ONCLK or the off-clock signal OFFCLK based on the on-clock signal ONCLK and the off-clock signal OFFCLK supplied to the front end of the signal branch unit 131 and the gate clock signals output from the rear end of the signal selection unit 133 and corrects (or recovers or compensates) the omission if the omission is generated in the on-clock signal ONCLK or the off-clock signal OFFCLK. The correction circuit unit 135 is the same as that of the first embodiment of the present invention, and for a detailed description of the correction circuit unit 135, reference may be made to the descriptions of FIGS. 3 to 9.

The signal control unit 137 controls and outputs the falling edge sections of the gate clock signals GCLK output by the signal selection unit 133. (refer to a part of a gate clock signal GCLK1 of FIG. 11 where (a) is changed into (b)). The signal control unit 137 may be placed behind the signal selection unit 133 or the level conversion unit 139 in order to reduce consumption power so that the levels of the falling edge sections of the gate clock signals GCLK are lowered, but the present invention is not limited thereto.

The level conversion unit 139 converts the levels of the gate clock signals output by the signal control unit 137 into levels at which the transistor of the display panel may be driven and outputs finally generated gate clock signals GCLK.

In accordance with the aforementioned configuration, when an abnormal signal occurs, the level shift unit in accordance with the second embodiment of the present invention can detect whether abnormality has occurred in an on/off-clock signal output by the timing control unit and correct the abnormality through recovery, such as the delay or skip of a waveform and the addition and replacement of a signal.

As described above, the present invention is advantageous in that it can discover or detect whether abnormality has occurred in an on/off-clock signal and can prevent a problem in that a display panel displays an abnormal image by correcting (or recovering or compensating) the abnormality. Furthermore, the present invention is advantageous in that it can stabilize a scan signal output by the scan driving unit although output abnormality is generated in the timing control unit. Furthermore, the present invention is advantageous in that it can improve the reliability and stability of the scan driving unit.

What is claimed is:

1. A display device, comprising:

a display panel;

a scan driving unit configured to supply a scan signal to the display panel; and a timing control unit configured to control the scan driving unit, wherein the scan driving unit comprises a correction circuit unit configured to detect whether a clock signal output by the timing control unit is normal or abnormal, wherein the correction circuit unit is configured to correct one or more of an on-clock signal and an off-clock signal output by the timing control unit when an omission is detected in one or more of the on-clock signal and the off-clock signal, wherein when an omission is detected in the off-clock signal output by the timing control unit, the correction circuit unit is configured to correct the off-clock signal by replacing an on-clock signal subsequent to the omitted off-clock signal with an off-clock signal.

2. The display device of claim 1, wherein:

the scan driving unit is configured to comprise a level shift unit comprising the correction circuit unit and a shift register unit generating the scan signal in response to a gate clock signal output by the level shift unit.

3. The display device of claim 2, wherein when an omission is detected in at least one of the on-clock signal and the off-clock signal output by the timing control unit, the correction circuit unit is configured to correct the gate clock signal output by the level shift unit.

4. The display device of claim 3, wherein when an omission is detected in the on-clock signal output by the timing control unit, the correction circuit unit is configured to correct the on-clock signal so that an Nth gate clock signal and an (N+1)th gate clock signal have an identical state in response to an on-clock signal subsequent to the omitted on-clock signal.

5. The display device of claim 2, wherein:

the correction circuit unit is configured to comprise first to fourth correction circuit units, the first correction circuit unit detects whether an omission has occurred in the off-clock signal based on the on-clock signal output by the timing control unit and an on-clock signal and an off-clock signal output by the fourth correction circuit unit, the second correction circuit unit detects whether an omission has occurred in the on-clock signal based on the off-clock signal output by the timing control unit and the on-clock signal and the off-clock signal output by the fourth correction circuit unit, the third correction circuit unit corrects an omitted part by replacing the omitted part with an on-clock signal or an off-clock signal if the omitted part is generated in the on-clock signal or the off-clock signal, and the fourth correction circuit unit corrects gate clock signals if an omitted part is generated in the on-clock signal or the off-clock signal.

6. The display device of claim 5, wherein the first correction circuit unit recognizes a single off-clock signal as a normal state when the single off-clock signal is generated between two on-clock signals and recognizes a single off-clock signal as an abnormal state that is an off-clock signal omission state when the single off-clock signal is not generated between two on-clock signals.

7. The display device of claim 5, wherein the second correction circuit unit recognizes a gate clock signal after next as a normal state if the gate clock signal after next maintains a logic high state until a single gate clock signal is terminated and recognizes a gate clock signal after next as an abnormal state that is an on-clock signal omission state if the gate clock signal after next does not maintain a logic high state until a single gate clock signal is terminated.

8. A method of driving a display device, comprising:

supplying an on-clock signal and an off-clock signal, output by a timing control unit, to a scan driving unit;

detecting whether the on-clock signal and the off-clock signal supplied to the scan driving unit are normal or abnormal; and correcting at least one of the on-clock signal and the off-clock signal when an omission is detected in at least one of the on-clock signal and the off-clock signal, wherein when an omission is detected in the off-clock signal, an on-clock signal subsequent to the omitted off-clock signal is replaced with an off-clock signal.

9. The method of claim 8, wherein when an omission is detected in the on-clock signal, an Nth gate clock signal and an (N+1)th gate clock signal are corrected to have an identical state in response to an on-clock signal subsequent to the omitted on-clock signal.

* * * * *